US008967439B2

(12) United States Patent
Vitangcol et al.

(10) Patent No.: US 8,967,439 B2
(45) Date of Patent: Mar. 3, 2015

(54) SHOULDER POUCH TO SECURE DOCUMENTS

(71) Applicant: Wellspring Ideas, LLC., Menomonee Falls, WI (US)

(72) Inventors: Rosalio A. Vitangcol, Menomonee Falls, WI (US); David Lee Clark, Waukesha, WI (US)

(73) Assignee: Wellspring Ideas, LLC., Menomonee Falls, WI (US)

( * ) Notice: Subject to any disclaimer, the term of this patent is extended or adjusted under 35 U.S.C. 154(b) by 0 days.

(21) Appl. No.: 14/187,878

(22) Filed: Feb. 24, 2014

(65) Prior Publication Data

US 2014/0239032 A1 Aug. 28, 2014

Related U.S. Application Data

(60) Provisional application No. 61/850,806, filed on Feb. 25, 2013.

(51) Int. Cl.
*A45F 3/04* (2006.01)

(52) U.S. Cl.
CPC ..... *A45F 3/04* (2013.01)
USPC ..... 224/646; 224/627; 224/259; 224/645; 224/655

(58) Field of Classification Search
USPC ..... 224/624, 625, 192, 606, 626, 627, 637, 224/638, 639, 640, 259, 260, 262, 646, 645, 224/655; D3/218
See application file for complete search history.

(56) References Cited

U.S. PATENT DOCUMENTS

| | | | | |
|---|---|---|---|---|
| 3,739,961 | A | 6/1973 | Soukeras | |
| 3,797,715 | A | 3/1974 | Scialdone | |
| 4,811,768 | A | 3/1989 | Williams | |
| 4,865,238 | A | 9/1989 | Bianchi | |
| 5,067,642 | A | 11/1991 | Fodge | |
| 5,246,153 | A | 9/1993 | Beletsky | |
| 5,775,558 | A | 7/1998 | Montalbano | |
| 6,016,944 | A | 1/2000 | Girbert | |
| 6,543,661 | B1 | 4/2003 | Lazur | |
| 6,568,575 | B1 | 5/2003 | Bartholomew | |
| 6,892,914 | B2 | 5/2005 | Girbert | |
| 7,370,781 | B2 | 5/2008 | Gambrill | |
| 8,302,830 | B1 | 11/2012 | Jensen | |
| 8,328,058 | B2 | 12/2012 | Wilson | |
| 8,479,958 | B1 | 7/2013 | Swift | |
| 2004/0034901 | A1 | 2/2004 | Trombetti | |
| 2005/0167017 | A1 | 8/2005 | Kizaire et al. | |
| 2011/0233244 | A1 | 9/2011 | Platts | |
| 2012/0292363 | A1 * | 11/2012 | Crawford | 224/655 |
| 2012/0312846 | A1 | 12/2012 | Forbes et al. | |
| 2013/0126228 | A1 | 5/2013 | Jordan | |
| 2014/0034520 | A1 * | 2/2014 | Scicluna | 206/37 |

* cited by examiner

*Primary Examiner* — Brian D Nash
*Assistant Examiner* — Corey Skurdal
(74) *Attorney, Agent, or Firm* — Boyle Fredrickson, S.C.

(57) ABSTRACT

A shoulder pouch for securing documents or the like, which is fitted underneath a users arm and protects against pick pocketing and wireless identity theft while still being easily accessed. The present invention provides a pouch which is harnessed to the body and angled from horizontal such that the pouch can be easily accessed with the opposite hand. The pouch provides a secure harnessed attachment about the user's body and RFID protection.

18 Claims, 3 Drawing Sheets

FIG. 3

SHOULDER POUCH TO SECURE DOCUMENTS

CROSS REFERENCE TO RELATED APPLICATION

This application claims the benefit of U.S. provisional application Ser. No. 61/850,806 filed Feb. 25, 2013 and hereby incorporated by reference.

STATEMENT REGARDING FEDERALLY SPONSORED RESEARCH OR DEVELOPMENT

Not Applicable

BACKGROUND OF THE INVENTION

The present invention relates to an apparatus for securing personal effects, such as passports and credit cards, close to the body and in particular, to a pouch harnessed underneath a user's arm to protect the user from pick pocketing and wireless identity theft, while still being easily accessed by the user.

Travelers must often travel with a number of common personal effects, such as passports and credit cards, which must be frequently accessed while on the go. With our quickly evolving technological advances, the danger of "pick pocketing" is only one concern for today's travelers. Travelers must also be aware of wireless identity theft, which allows the thief to compromise an individual's personal identifying information without ever laying a hand on the victim.

Many credit, debit, or government issued identification cards are radio-frequency (RF)-enabled and carry a radio-frequency identification (RFID) tag which contains electronically stored information. When the tags come into contact with radio waves, usually from a RFID scanner or reader, they respond by sending out a radio signal with information located in the tag. This information may be encoded personal identification information, including a person's name, address, Social Security Number, and credit card information. Radio frequency tagged cards are often preferred over magnetic strip cards because transactions can be completed more quickly.

One of the limitations of this technology is that thieves are able to take advantage of the REED tags by using RFID scanners or readers near a user's RF-enabled credit cards or passports, without their knowledge, to obtain personal identification information. With this information, a thief performs RFID identity theft without the victim ever knowing.

SUMMARY OF THE INVENTION

The present invention provides an improved travel pouch for securing personal effects or the like which is strapped beneath a user's arm and close to the user's body. In this respect, the inventors have recognized that there is a need for a pouch which is able to secure personal effects often carried during travel, such as passports and credit cards, which may be discreetly worn underneath a suit, sports coat, or jacket. In another respect, the inventors have recognized that these personal effects must be quickly and easily accessed during travel, such as when navigating through airport security. Accordingly, the present invention provides a pouch which is harnessed to the body and angled from horizontal such that the pouch can be easily accessed by the opposite arm. Moreover, the inventors have recognized the dangers of pick pocketing and wireless identity theft. Accordingly, the present invention provides a secure harnessed attachment about the user's body, and RFID protection built into the pouch lining.

Specifically, in one embodiment, the present invention provides a pouch assembly having an opening to receive contents along a pouch axis. A strap system positions and retains the pouch under a user's arm so that the pouch axis is at a generally horizontal angle.

It is thus a feature of at least one embodiment of the invention to provide a shoulder pouch assembly with a pouch disposed underneath the arm and with the opening at a generally horizontal angle so that the user can easily access the opening with the opposite hand.

The pouch axis may be substantially 45 degrees from horizontal. Alternatively, pouch axis may be between 35 and 45 degrees from horizontal.

It is thus a feature of at least one embodiment of the invention to allow the pouch to be easily accessed at an angle comfortable for the user's opposite arm, yet angled so the personal effects do not easily fall out of the pouch.

The opening of the pouch may be sized to receive a standard sized passport. The opening may be 5.5" wide.

It is thus a feature of at least one embodiment of the invention to allow the assembly to be used to carry commonly used travel documents, such as passports.

The pouch may have an RFID blocker liner. The RFID blocker liner may be a nickel and copper shielding.

It is thus a feature of at least one embodiment of the invention to prevent RFID identity theft.

A belt strap loop may extend downwardly from the pouch.

It is thus a feature of at least one embodiment of the invention to provide a more secure attachment of the pouch to the user's body and prevent shifting of the pouch.

The pouch may have a flap enclosing the opening.

It is thus a feature of at least one embodiment of the invention to prevent personal effects from falling out of the opening.

The strap system may have a buckle with attachment points for attaching a plurality of straps. A vertically extending strap has a first end attached to the buckle and a second end attached to a horizontally extending strap which extends below the buckle and has a first and second end. The horizontally extending strap is attached to a second end of the pouch. The assembly also includes a first arm strap having a first end attached to the buckle and a second end attached to a first end of the pouch. A second arm strap has a first end attached to the buckle and a second end attached to the second end of the horizontally extending strap.

In another embodiment, the present invention provides a travel pouch for personal effects. The pouch has an opening to receive contents along a generally horizontal pouch axis. And it has a strap system for fitting about a human body and positioning and retaining the pouch under a user's arm and where the sidewalls of the pouch are substantially parallel with the pouch axis.

In another embodiment, the present invention provides a method of securing personal effects. The method includes providing a pouch having an opening to receive contents along a pouch axis. A strap system positions and retains the pouch under a user's arm so that the pouch axis is at a generally horizontal angle. The strap system is fitted onto a human body. Finally, personal effects are placed into the opening of the pouch.

These particular objects and advantages may apply to only some embodiments falling within the claims and thus do not define the scope of the invention.

DETAILED DESCRIPTION OF THE PREFERRED EMBODIMENT

Figure 1:
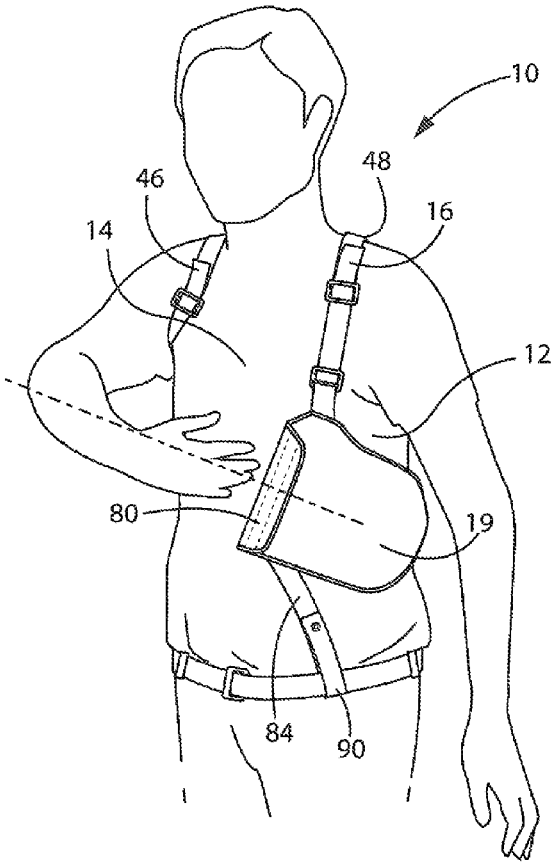
FIG. 1 is a front perspective view of a shoulder pouch assembly according to the present invention shown being worn by an individual.
Figure 2:
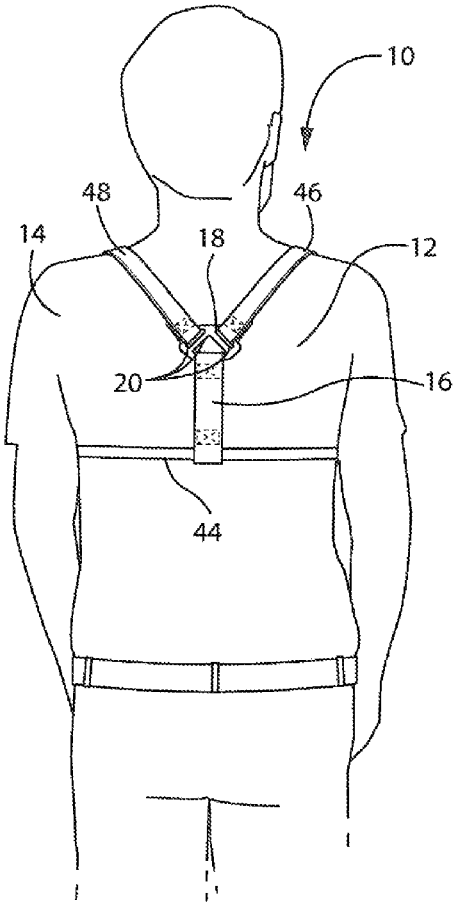
FIG. 2 is a rear isometric view of the shoulder pouch assembly of FIG. 1 being worn by an individual.

Referring now to FIGS. 1 and 2, a wearable shoulder pouch assembly 10 according to the present invention is fitted onto a user's body 12. The shoulder pouch assembly 10 may be worn underneath and/or over clothing 14 so that it is securely positioned in close proximity to the user's body 12. It is contemplated that the shoulder pouch assembly 10 may be easily concealed underneath a suit, sports coat, or jacket. In this manner, the proximity of the shoulder pouch assembly 10 to the user's body 12 allows the user to remain aware of the presence of the pouch assembly 10 without concern.

The shoulder pouch assembly 10 provides a number of components coupled together to form a strap system 16 around the user's body 12. The strap system 16 securely positions a pouch 19 underneath the user's arm and in close proximity to the user's body 12.

Figure 3:
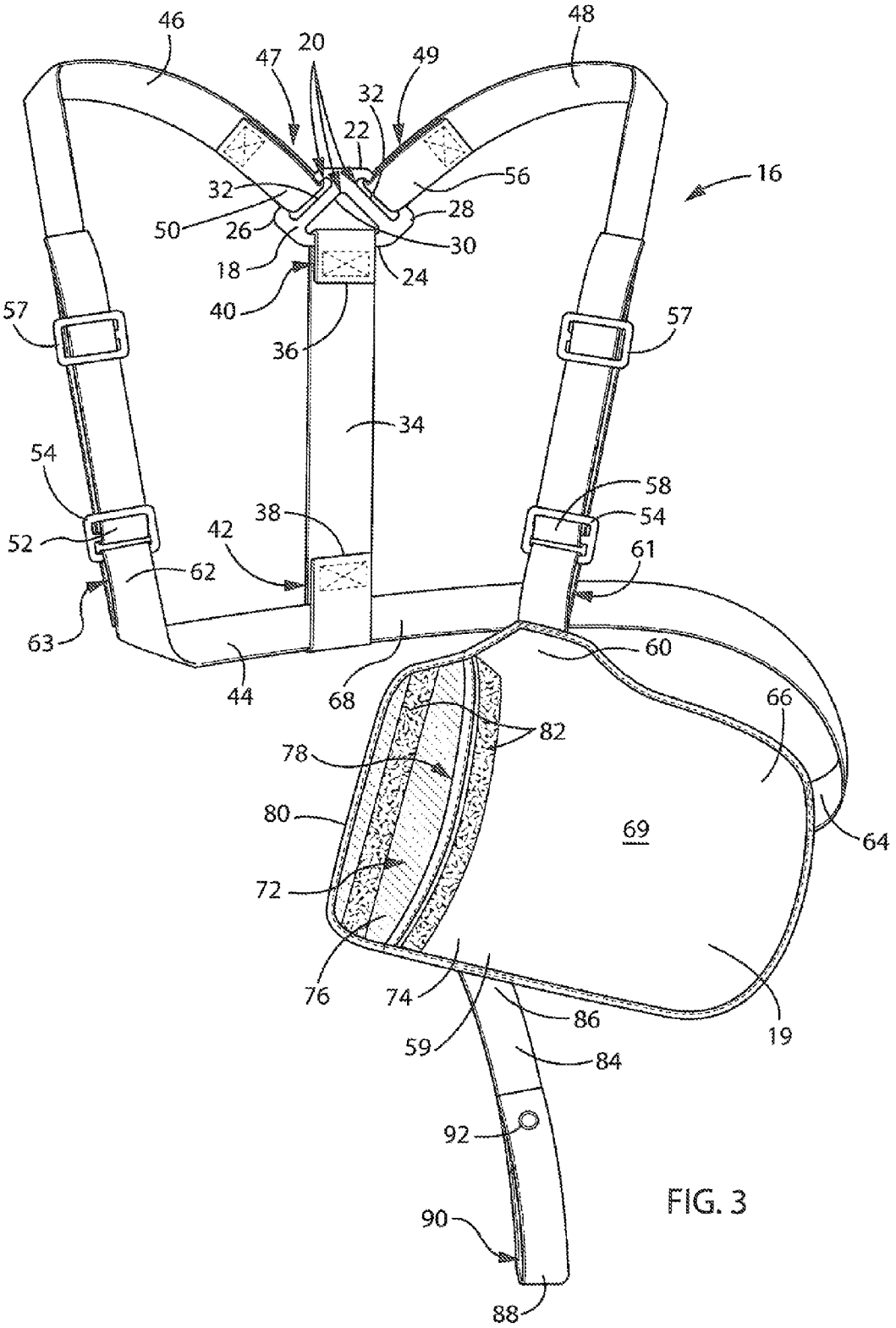
FIG. 3 is a front isometric view of the shoulder pouch assembly FIG. 1 shown removed from the individual's body.
Figure 4:
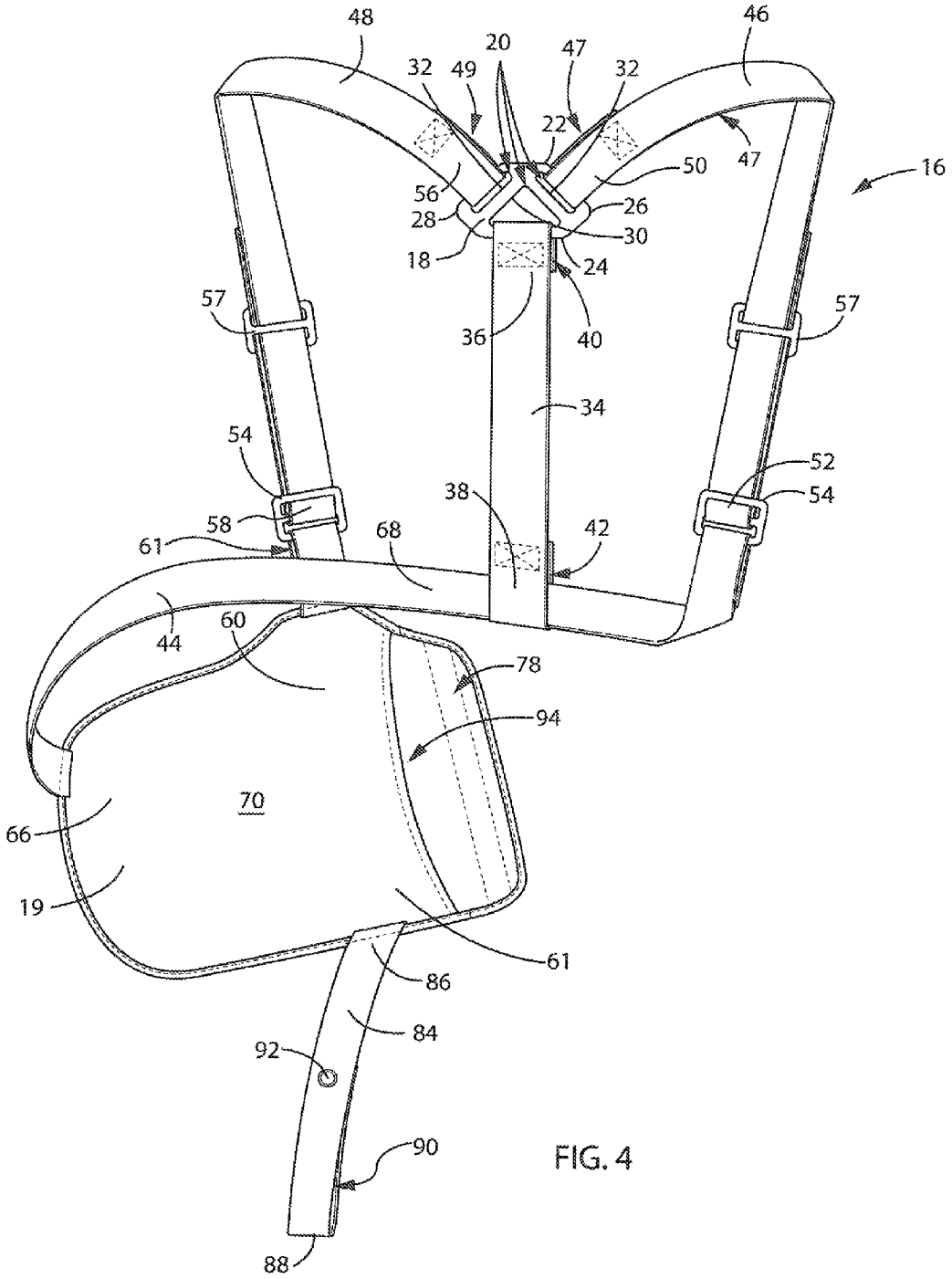
FIG. 4 is a rear isometric view of the shoulder pouch assembly of FIG. 3 removed from the individual's body.

Referring now to FIGS. 3 and 4, the strap system 16 of the present invention provides an adjustable buckle 18. The buckle 18 is preferably a 3-point buckle constructed of a thin plastic. The buckle 18 may have a plurality of holes 20 for attachment of looped straps through the holes 20. As shown, the buckle 18 provides a generally trapezoidal construction providing straight edges at a top 22 opposite a bottom 24. The top 22 and bottom 24 are joined at their right and left edges by acutely angled sides 26, 28, respectively. An inner surface of the buckle 18 presents a plurality of holes 20, preferable three, conforming to a lower generally triangular hole 30 and two upper capsule-shaped holes 32. The triangular hole 30 attaches a downwardly extending elastic strap 34, and the two capsule shapes holes 32 attaches the right 46 and left 48 arm straps, as will be further discussed below.

An elastic strap 34 extends downwardly from the triangular hole 30. The elastic strap 34 has a length (being in one embodiment proximally 6 inches or 7.5 inches long) with a width (being in one embodiment proximally 1.5 inches wide). Opposite ends 36, 38 of the elastic strap 34 are looped such that the ends of the strap 34 are folded over and sewn to a portion of the strap inward from the ends 36, 38 of the strap 34 and providing open loops 40, 42. A first end 36 of the strap 34 is looped through the triangular hole 30 and a second end 38 of the strap 34 is looped around a horizontally extended elastic belt 44, as will be further discussed below.

Desirably, the elastic strap 34 is constructed of polyester elastic to flexibly expand according to a user's body 12 size. It is contemplated that the elastic strap 34 may be constructed out of a number of different materials providing the desired elasticity.

A right arm strap 46 and left arm strap 48 extend upwardly from the two capsule-shaped holes 30. A right arm strap 46 has a length (being in one embodiment proximally 20 or 18¾ inches long) with a width (being in one embodiment proximally 1 inch wide). A first end 50 of the right arm strap 46 is looped 49 through the right capsule-shaped hole 32 and extends at an upwardly right angle (as seen from the rear). A second end 52 is secured to a plastic 1-bar buckle 54, which couples the second end 52 to the elastic belt 44. Between the first end 50 and the second end 52 a plastic slide adjuster 57 provides size adjustment to the right arm strap 46. The slide adjuster 57 may be 1-bar or 3-bar, as known in the art. The slide adjuster 57 slides along the length of the right arm strap 46 to lengthen or shorten it. It is contemplated that a plastic fastener buckle (not shown), such as a quick release buckle, may be selectively used in place of the 1-bar buckle 54 to allow the right arm strap 46 to detach from the elastic belt 44 quickly and easily.

A left arm strap 48 has a length (being in one embodiment proximally 21 inches or 12.5 inches long) with a width (being in one embodiment proximally 1 inch wide). A first end 56 of the left arm strap 48 is looped 47 through the left capsule-shaped hole 32 and extends at an upwardly left angle (as seen from the rear). A second end 58 is secured to a plastic 1-bar buckle 54, which couples the second end 58 to a loop 61 of the upper front end 60 of the pouch 19. Between the first end 56 and the second end 58 a plastic slide adjuster 57 provides size adjustment to the left arm strap 48. Again, the slide adjuster 57 may be 1-bar or 3-bar, as known in the art. The slide adjuster 57 slides along the length of the left arm strap 48 to lengthen or shorten it.

It is understood that the buckles and slide adjusters described above may be replaced with any type of buckle or slide adjuster known in the art. Desirably, the right 46 and left 48 arm straps are constructed of a polypropylene webbing. However, it is contemplated that any known durable materials may be used.

An elastic belt 44 extends horizontally and has a length (being in one embodiment proximally 28 inches long) with a width (being in one embodiment proximally 1 inch wide). The elastic belt 44 is positioned a vertical distance below the buckle 18 commensurate with the length of the elastic strap 34. The elastic belt 44 is looped 63 at a first end 62 and coupled to the plastic buckle 54. A second end 64 is coupled to an upper rear end 66 of the pouch 19. In one embodiment, the attachment of the second end 64 to the pouch 19 may be a sewn attachment. A middle section 68 may be threaded through the loop 42 of the second end 38 of the elastic strap 34 to couple the elastic strap 34 to the elastic belt 44. In one embodiment, Velcro (not shown) is applied to the middle section 68 to more securely attach the middle section 68 of the elastic belt 44 to the loop 42 of the second end of the elastic strap 34. The elastic belt 44 may be constructed of polyester elastic.

The strap system 16 is attached to a pouch 19. The pouch 19 has a generally oblong construction having a front layer 69 and a back layer 70 sewn together at an outer perimeter to define a receptacle 72 of the pouch 19 for receiving personal effects. A generally horizontally disposed opening 78 is provided where the front 69 and back 70 layers are not sewn together at the perimeter and which allow access to the inner receptacle 72. In one embodiment, the opening 78 is substantially 6-inches wide or 5.5-inches wide. In an alternative embodiment, the opening 78 may have a width commensurate with the width of a standard passport.

The front 69 and back 70 layers are both constructed of an outer liner 74 and an inner liner 76. In one embodiment, the outer liner 74 is a nylon material, such as urethane coated 400 denier nylon. It is contemplated that other durable materials may be used, such as polyester, polyurethane and denier. The inner liner 76 is a RF and/or Electromagnetic interference (EMI) shielding material. In one embodiment, the inner liner 76 is plain weave fabric plated with nickel and copper. It is contemplated that other RF/EMI blockers may be used, such as mylar and aluminum.

The pouch 19 has a length (being in one embodiment proximally 8.5 inches long) and a width (being in one embodiment 6 inches wide). The back layer 70 may extend slightly longer than the front layer 69 to extend past and overlap the front layer 69 and provide an overlapping flap 80 which may be secured with Velcro 82 or hook-loop fastener. The flap 80 securely retains the contents of the receptacle 72. It is contemplated that the Velcro 82 may be replaced with other attachment means, such as a zipper or buttons. The back layer 70 may also have an additional pocket(s) 94 for securing personal effects.

An upper front end 60 proximate the opening 78 may have a proximately 1-inch billed protrusion securing a loop 61 which attaches to the plastic buckle 54 for coupling the pouch 19 to the second end 58 of the left arm strap 48. An upper rear end 66 extends rearwardly from the opening 78 and attaches a second end 64 of the elastic belt 44. The attachment of the second end 64 to the pouch 19 may be a sewn attachment.

A belt attachment strap 84 may extend downwardly and rearwardly from a lower front end 59 of the pouch 19. In one embodiment, the strap 84 is attached 1-inch rearwardly from the opening 78 of the pouch 19. In one embodiment, the strap 84 is attached at an angle of substantially 37-degrees or 45-degrees from the bottom edge of the pouch 19. The belt attachment strap 84 has a first end 86 coupled to the pouch 19 which may be a sewn attachment. A second end 88 of the strap 84 is a snapped loop 90. A snap 92 allows the loop to be opened and closed so that the strap 84 may be removably attached and detached from a belt worn on the user's body 12. The belt attachment strap 84 may be constructed of polypropylene webbing.

As seen in FIGS. 1 and 2, the shoulder pouch assembly 10 is worn on the user's body 12 by placing the right arm strap 46 around the user's right arm and the left arm strap 48 is placed around the user's left arm. The plastic slide adjusters 57 of the right 46 and left 48 arm straps may be adjusted to lengthen or shorten the straps. The elastic belt 44 is to be situated comfortably mid-way up the user's back. The loop 90 of the belt attachment strap 84 may be removably secured to the belt of the user for a more secure attachment.

When worn by the user, the pouch 19 is situated underneath the user's arm and extends slightly forward of the side of the user's body 12. The pouch 19 is oriented at a generally horizontal angle and preferably, at a slightly upward angle so that the user can easily access the opening 78 of the pouch 19 with his or her right hand (or opposite hand of the pouch position). As seen in FIG. 1, a dotted line represents the pouch axis at an angle of 45±10 degrees from horizontal. In one embodiment the pouch axis is substantially 45 degrees from horizontal. In an alternative embodiment the pouch axis is between 40 and 50 degrees from horizontal. In an alternative embodiment the pouch axis is between 35 and 45 degrees from horizontal.

The strap assembly 16 provides support above and below the user's shoulder to position the pouch. 19 at a slightly upward angle, as described above. When worn with taunt straps and without sagging, the strap assembly 16 positions the pouch 19 such that the sidewalk of the receptacle 72 are parallel to the pouch axis, and the pouch axis is oriented at a generally horizontal angle, and preferably, at a slight upward angle. The vertically extending elastic strap 34, right arm strap 46, and left arm strap 48 provide an upward tension to the front upper end 60 of the pouch 19. The elastic belt 44 retains a horizontal and downward tension at the rear end 66 of the pouch 19. The belt attachment strap 84 further maintains the strap assembly 16 in a generally fixed position.

The user can place personal effects into the opening 78 of the pouch 19 and secure the effects in the receptacle 72 be placing the flap 80 of the back layer 70 over the front layer 69 and securing the Velcro 82. Additional items may be placed in the pockets 94 of the back layer 70.

It is understood that the right and left sides of the pouch assembly 10 may be interchanged. Also, the different components of the assembly 10 may be disposed on either side of the assembly 10.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. A shoulder pouch assembly for securing personal travel effects comprising:

a pouch having an opening to receive contents along a pouch axis;

a strap system for positioning and retaining the pouch under a user's arm so that the pouch axis is at an inclined angle from horizontal and comprising:

a vertically extending strap having a first end extending from a junction positioned on the user's back and a second end coupled to a horizontally extending strap adapted to extend below the junction and transverse the user's back wherein the horizontally extending strap has a first end coupled to a rear end of the pouch and a second end;

a first arm strap having a first end extending from the junction and a second end coupled to a front end of the pouch; and a second arm strap having a first end extending from the junction and a second end coupled to the second end of the horizontally extending strap.

2. The shoulder pouch assembly of claim 1 wherein the pouch axis is substantially 45 degrees from horizontal.

3. The shoulder pouch assembly of claim 1 wherein the pouch axis is between 35 degrees and 45 degrees from horizontal.

4. The shoulder pouch assembly of claim 1 wherein the pouch opening is sized to receive a standard sized passport.

5. The shoulder pouch assembly of claim 1 wherein the pouch opening is 5.5" wide.

6. The shoulder pouch assembly of claim 1 wherein the pouch has a RFID blocker liner.

7. The shoulder pouch assembly of claim 6 wherein the RFID blocker liner is nickel and copper shielding.

8. The shoulder pouch assembly of claim 1 wherein a belt strap loop extends downwardly from the pouch and is configured to be attached to a waist belt.

9. The shoulder pouch assembly of claim 1 wherein the pouch has a flap enclosing the opening and includes hook and loops fasteners for removably securing the flap over the opening.

10. The shoulder pouch assembly of claim 1 wherein the strap system provides a tension force above and below a user's shoulder to eliminate slack in the strap system.

11. A travel pouch for personal effects comprising:

a pouch having an opening adapted to receive contents along an inclined pouch axis; and a strap system for fitting about a human body and positioning and retaining the pouch under a user's arm wherein the pouch has sidewalls that are substantially parallel with the pouch axis and comprising a vertically extending strap having a first end extending from a junction positioned on the user's back and a second end coupled to a horizontally extending strap adapted to extend below the junction and transverse the user's back wherein the horizontally extending strap has a first end coupled to a rear end of the pouch and a second end;

a first arm strap having a first end extending from the junction and a second end coupled to a front end of the pouch; and a second arm strap having a first end extending from the junction and a second end coupled to the second end of the horizontally extending strap; and a belt strap loop extending downwardly from the pouch and configured to be attached to a waist belt.

12. The travel pouch of claim 11 wherein the pouch opening is 5.5" wide.

13. The travel pouch of claim 11 wherein the pouch axis is substantially 45 degrees from horizontal.

14. A method of securing personal effects comprising:

providing a shoulder pouch assembly comprising:

the pouch having an opening to receive contents along the pouch axis;

a strap system for positioning and retaining a pouch under a user's arm so that a pouch axis is at an inclined angle from horizontal and comprising a vertically extending strap having a first end extending from a junction positioned on the user's back and a second end coupled to a horizontally extending strap adapted to extend below the junction and transverse the user's back wherein the horizontally extending strap has a first end coupled to a rear end of the pouch and a second end;

a first arm strap having a first end extending from the junction and a second end coupled to a front end of the pouch; and a second arm strap having a first end extending than the junction and a second end coupled to the second end of the horizontally extending strap; and a belt strap loop extending downwardly from the pouch and configured to be attached to a waist belt; and fitting the strap system onto a human body so that the strap system is taunt;

attaching the belt strap loop to the waist belt to secure the first end of the pouch to the waist belt; and placing personal effects into the opening of the pouch.

15. The method of claim 14 wherein the opening is sized to receive a standard sized passport.

16. The method of claim 14 wherein the opening is 5.5" wide.

17. The method of claim 14 wherein the opening is substantially 45 degrees from horizontal.

18. The method of claim 14 wherein the pouch has a RFID blocker liner.

* * * * *